US007052271B2

(12) United States Patent
Brown et al.

(10) Patent No.: US 7,052,271 B2
(45) Date of Patent: May 30, 2006

(54) DRAFT INDUCER SYSTEM

(75) Inventors: Fred A. Brown, Coronado, CA (US); Phillip Bowen, San Diego, CA (US); Jeffrey E. From, San Diego, CA (US)

(73) Assignee: Comair Rotron, Inc., San Diego, CA (US)

( * ) Notice: Subject to any disclaimer, the term of this patent is extended or adjusted under 35 U.S.C. 154(b) by 0 days.

(21) Appl. No.: 10/655,534

(22) Filed: Sep. 4, 2003

(65) Prior Publication Data

US 2004/0129264 A1 Jul. 8, 2004

Related U.S. Application Data

(60) Provisional application No. 60/409,142, filed on Sep. 9, 2002, provisional application No. 60/499,844, filed on Sep. 3, 2003.

(51) Int. Cl.
*F23N 3/00* (2006.01)

(52) U.S. Cl. ..... 431/20; 126/80

(58) Field of Classification Search ..... 431/20; 126/80, 312; 415/116; 110/162; 34/97
See application file for complete search history.

(56) References Cited

U.S. PATENT DOCUMENTS 4,867,106 A * 9/1989 Staats ..... 122/18.31
5,075,608 A * 12/1991 Erdman et al. ..... 318/599
5,199,385 A * 4/1993 Doss ..... 431/20
5,222,888 A * 6/1993 Jones et al. ..... 431/20
5,352,099 A 10/1994 Anstine et al. ..... 417/366
5,524,556 A 6/1996 Rowlette ..... 110/162
5,589,760 A * 12/1996 Lee ..... 323/247
5,720,231 A * 2/1998 Rowlette et al. ..... 110/162
5,791,763 A * 8/1998 Kam-Hoi ..... 362/96
5,950,573 A * 9/1999 Shellenberger et al. .. 122/18.31
6,231,311 B1 5/2001 Gatley et al. ..... 417/53
6,398,512 B1 * 6/2002 Stewart ..... 417/53
6,459,575 B1 10/2002 Esterberg ..... 361/687

FOREIGN PATENT DOCUMENTS

JP 7216959 A 1/1994
JP 11177266 A 12/1997

OTHER PUBLICATIONS

Grossner, Nathan R. *Transformers for Electronic Circuits, 2nd ed.* N.Y., McGraw-Hill, Inc., 1983. pp. 1-4.*
Patent Abstracts of Japan vol. 1995, no. 11, Dec. 26, 1995 &-JP 07 216959 A (INAX Corp.), Aug. 15, 1995 abstract.
Patent Abstracts of Japan vol. 1999, no. 12, Oct. 29, 1999 &-JP 11 177266 A (PFU Ltd), Jul. 2, 1999 abstract.

* cited by examiner

*Primary Examiner*—Alfred Basichas
(74) *Attorney, Agent, or Firm*—Bromberg & Sunstein LLP

(57) ABSTRACT

A draft inducer system has a voltage reducer capable of converting an input AC voltage to a reduced voltage, and an inducer unit capable of being coupled with the voltage reducer. The voltage reducer includes a reducer housing, a set of prongs extending from the reducer housing, and an output interface capable of delivering the reduced voltage. The set of prongs is capable of plugging into an AC outlet. The inducer unit has a unit housing, an air moving device within the unit housing, and a mixing chamber formed by the unit housing. The mixing chamber has an exhaust input to receive exhaust from a burning fuel, and an ambient air input for receiving ambient air. The ambient air mixes with the exhaust in the mixing chamber to produce mixed air. Accordingly, the mixing chamber also has a mix output capable of directing the mixed air from the mixing chamber.

11 Claims, 5 Drawing Sheets

DRAFT INDUCER SYSTEM

This patent application claims priority from provisional U.S. patent application No. 60/409,142, filed Sep. 9, 2002, entitled, "DRAFT INDUCER SYSTEM," and naming Fred A. Brown, Phillip Bowen, and Jeffrey E. From as inventors, the disclosure of which is incorporated herein, in its entirety, by reference. This patent application also claims priority from the provisional U.S. patent application No. 60/499,844 filed on Sep. 3, 2003, entitled, "DYNAMIC DRAFT INDUCER" and naming Fred A. Brown and Gregory R. Turi as inventors, the disclosure of which is incorporated herein, in its entirety, by reference.

FIELD OF THE INVENTION

The invention generally relates air movement and, more particularly, the invention relates to draft inducers.

BACKGROUND OF THE INVENTION

Fuel burning furnaces commonly have an attached draft inducer that mixes ambient air with exhaust gasses (i.e., fumes) produced by burning fuel. After the exhaust gasses and ambient air are mixed, they are vented from the furnace through an exhaust pipe. Among other benefits, draft inducers can improve efficiency by controlling the flow of exhaust gasses from their furnaces. Moreover, mixing the ambient air with the exhaust reduces the exhaust temperature, thus permitting simplified piping to be used for the exhaust pipe.

Many conventional draft inducers have an AC blower that is powered by a high voltage AC signal (e.g., 115 volts AC). As a result, such draft inducers typically are relatively large, have relatively high power consumption requirements, and run less efficiently. Moreover, for a number of reasons relating to the AC blower, local building codes often require that an electrician install the inducer, further increasing installation costs.

SUMMARY OF THE INVENTION

In accordance with one aspect of the invention, a draft inducer system has a voltage reducer capable of converting an input AC voltage to a reduced voltage, and an inducer unit capable of being coupled with the voltage reducer. The voltage reducer includes a reducer housing, a set of prongs extending from the reducer housing, and an output interface capable of delivering the reduced voltage. The set of prongs is capable of plugging into an AC outlet. The inducer unit has a unit housing, an air moving device within the unit housing, and a mixing chamber formed by the unit housing. The mixing chamber has an exhaust input to receive exhaust from a burning fuel, and an ambient air input for receiving ambient air. The ambient air mixes with the exhaust in the mixing chamber to produce mixed air. Accordingly, the mixing chamber also has a mix output capable of directing the mixed air from the mixing chamber.

In some embodiments, the air moving device includes a DC blower. Moreover, the reducer housing may be produced from a flexible material. The voltage reducer also may include a cord that terminates at the output interface, where the output interface is removably coupleable with the inducer unit. The voltage reducer also may include a transformer for producing the reduced voltage.

Various embodiments of the inducer unit include rectification circuitry to produce a substantially DC input voltage from the reduced voltage. Moreover, the system may have a hot water heater. In such case, the unit housing may be mounted to the hot water heater, where the hot water heater burns the fuel to produce the exhaust.

In accordance with another aspect of the invention, a draft inducer for controlling the exhaust of a fuel burning system (i.e., where the fuel burning system burns fuel after control circuitry that is a part of the system is energized) has an input for receiving power, an air moving device energized by power received from the input, and an output for selectively delivering the power to the control circuitry, which is energized by the power received via the output. The output switches the power to the control circuitry on and off as a function of the rotational speed of the air moving device.

In some embodiments, the draft inducer has a switch between the input and the output. The switch is configured to provide a closed circuit when the air moving device is operating at least at a predefined speed. The switch also may be configured to provide an open circuit when the air moving device is operating below the predefined speed. The open circuit prevents power from being delivered from the output.

The draft inducer also may have a processor that detects the rotational speed of the air moving device. The processor thus produces a power signal when the air moving device rotates at a predetermined rotational speed. Generation of the power signal causes the output to deliver power to the control circuitry.

In accordance with other aspects of the invention, a draft inducer system has a voltage reducer capable of converting an input AC voltage to a reduced voltage, and an inducer unit having a housing and an air moving device within the unit housing. The voltage reducer has a set of prongs capable of plugging into an AC outlet. In addition, the inducer unit is removably coupleable with the voltage reducer and is energized by the reduced voltage.

BRIEF DESCRIPTION OF THE DRAWINGS

The foregoing and advantages of the invention will be appreciated more fully from the following further description thereof with reference to the accompanying drawings wherein.

DESCRIPTION OF ILLUSTRATIVE EMBODIMENTS

In illustrative embodiments of the invention, a draft inducer has an external AC adapter that converts AC wall voltage to a reduced AC voltage. To those ends, the adapter has a pair of prongs 34 that readily plug into a conventional AC outlet, such as a wall outlet or power strip. Installation of the draft inducer therefore requires no specialized hard wired electrical connections. Details of this and related embodiments are discussed below.

In other embodiments, a draft inducer has an output that delivers power to a fuel burning system as a function of the rotational speed of its blower. Receipt of the power enables the fuel burning system to perform its underlying function (e.g., burning fuel to deliver heat). Accordingly, as a safety feature, the draft inducer can prevent the system from burning fuel (i.e., producing potentially toxic exhaust gas) when the blower is not operating. Details of this and related embodiments are discussed below.

Figure 1:
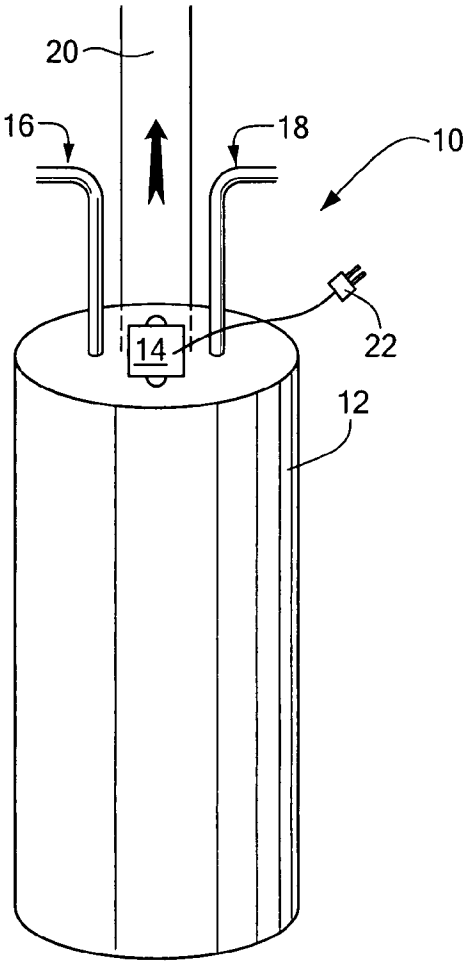
FIG. 1 schematically shows a draft inducer system that may be configured in accordance with illustrative embodiments of the invention.

FIG. 1 schematically shows a draft inducer system (the "system 10") that may be configured in accordance with illustrative embodiments of the invention. The system 10 has a fuel burning device 12 with a draft inducer 14 mounted to its top side. Among other things, the draft inducer 14 forcibly vents exhaust fumes produced by the burning fuel.

In illustrative embodiments, the fuel burning device 12 is a conventional natural gas hot water heater (also identified by reference number 12). Accordingly, various embodiments are discussed as being used with a natural gas hot water heater 12. Rather than having a hot water heater 12, however, the system 10 may have other types of fuel burning devices, such as boilers. Discussion of a hot water heater 12 thus is exemplary and, consequently, not intended to limit all embodiments of the invention. Moreover, various embodiments may be implemented with other types of burnable fuels, such as oil or wood. Accordingly, discussion of burning natural gas is not intended to limit all embodiments of the invention.

The draft inducer 14 illustratively is mounted over an exhaust opening in the hot water heater 12 to receive exhaust fumes produced by the burning fuel. In illustrative embodiments, that mounting is between a cold water intake pipe 16 and a hot water outlet pipe 18 at the top of the heater 12. When the system 10 is on, the draft inducer 14 mixes the exhaust fumes with ambient air within its interior, and forces the resultant mixture out of the premises via an exhaust pipe 20. Because the resultant mixture typically has a much lower temperature than that of the exhaust fumes, the exhaust pipe 20 can be produced from a lower cost material, such as conventional PVC piping.

The system 10 is powered by an AC adapter 22 that can be plugged into a conventional AC outlet. Accordingly, installation requires no specialized electrical expertise. Details of the draft inducer 14 and its interaction with the hot water heater 12 are discussed below with reference to FIGS. 2–7.

Figure 2:
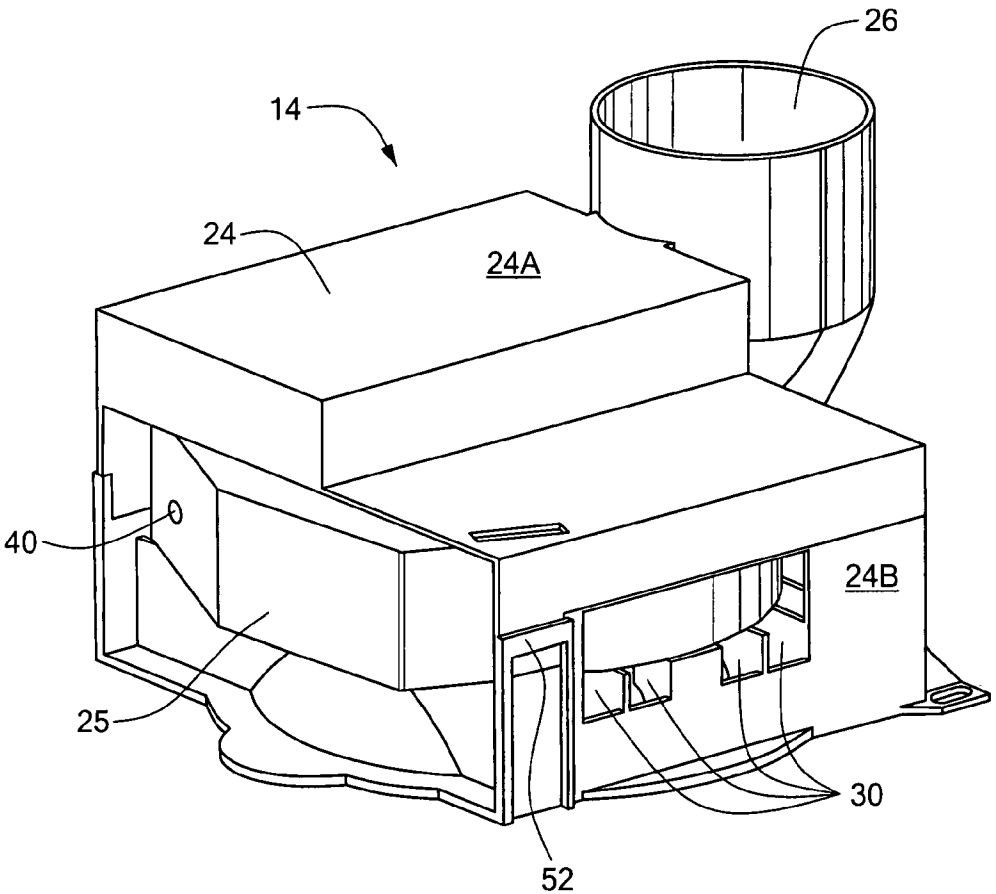
FIG. 2 schematically shows a draft inducer configured in accordance with illustrative embodiments of the invention.

FIG. 2 schematically shows a draft inducer 14 configured in accordance with illustrative embodiments of the invention. The inducer 14 has a metal or plastic housing 24 containing a blower 25 and forming an exhaust port 26 for directing the noted mixture of exhaust fumes and ambient air to the exhaust pipe 20. The housing 24 also forms an interior mixing chamber 28 for mixing ambient air with exhaust fumes. A plurality of ambient air inlets 30 formed in the side of the housing 24 permit the blower 25 to draw ambient air into the mixing chamber 28, thus enabling the exhaust to mix with the air.

Figure 3:
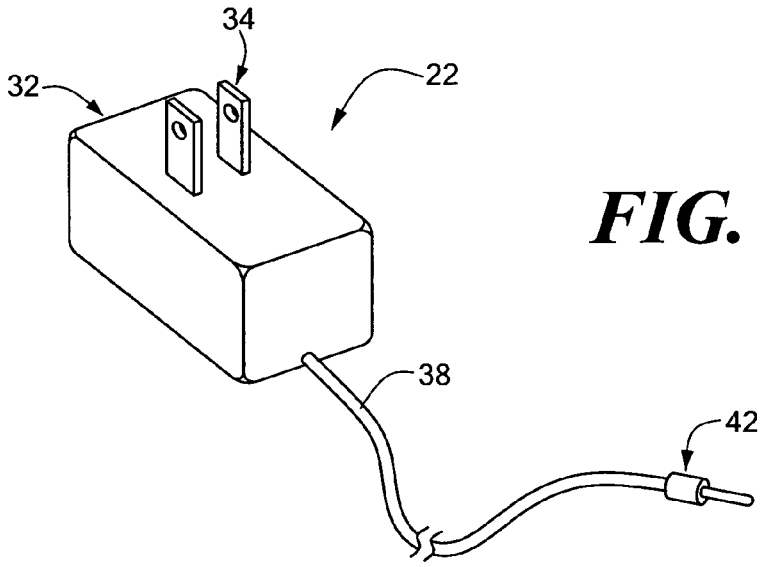
FIG. 3 schematically shows an external AC adapter that converts AC wall voltage to a reduced AC voltage.

FIG. 3 schematically shows more details of the external AC adapter 22, which converts AC wall voltage to a reduced AC voltage. Specifically, the adapter 22 has an adapter housing 32, a pair of prongs 34 (extending from the adapter housing 32) for mating with a wall plug (e.g., a home AC outlet, such as those in North America and Europe, or a power strip), and an internal transformer 36 (see FIG. 6) for reducing the wall voltage to a lower (stepped down) AC voltage. The adapter housing 32 may be produced from any conventional material used for these purposes, such as a hard or soft plastic.

In exemplary embodiments, the wall voltage is 115 volts AC, while the stepped down voltage is 24 volts AC. An electrical cord 38 transmits the stepped down voltage to the draft inducer 14. To that end, the cord 38 illustratively plugs into a mating female port 40 (see FIG. 2) on the draft inducer 14. Among other benefits, the adapter 22 electrically isolates the draft inducer 14 and hot water heater 12 from the power source. In addition, as noted above, the adapter 22 enables the system 10 to be installed without requiring specialized hard wired electrical connections.

The adapter 22 illustratively is removably coupleable with the mating female port 40 on the draft inducer 14. To that end, the adapter cord 38 may have a male contact member 42 that plugs into the mating female port 40 noted above. In other embodiments, however, the adapter cord 38 is wired directly into the mating female port 40 and thus, is not removably coupled with the draft inducer 14.

Figure 4:
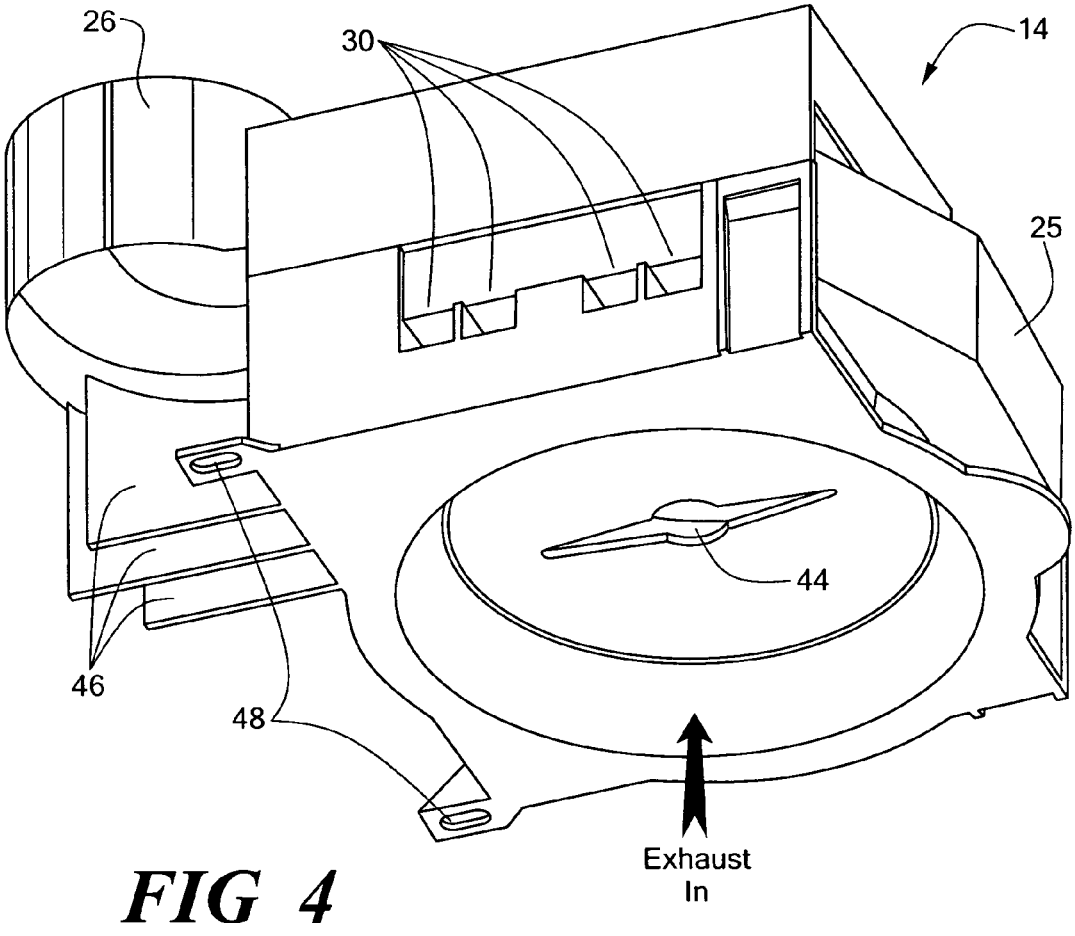
FIG. 4 schematically shows a bottom view of the draft inducer of FIG. 2.

FIG. 4 schematically shows a bottom view of the draft inducer 14 shown in FIG. 2. This view more clearly shows an exhaust inlet 44 formed through the bottom of the mixing chamber 28. The size and shape of the exhaust inlet 44 are selected to carefully control the amount of exhaust that can be drawn into the mixing chamber 28. Those skilled in the art can calculate this size and shape based upon the type of fuel being burned, the performance of the blower 25, the type of hot water heater 12, and other related parameters.

For extra support, the draft inducer 14 also has a plurality of support bosses 46 underneath the exhaust port 26. Accordingly, the support bosses 46 provide the structural integrity to the draft inducer 14, such as when the exhaust pipe 20 is coupled with the exhaust port 26. Additionally, the draft inducer 14 has a plurality of mounting members 48 for fastening the inducer housing 24 with the hot water heater 12.

Figure 5:
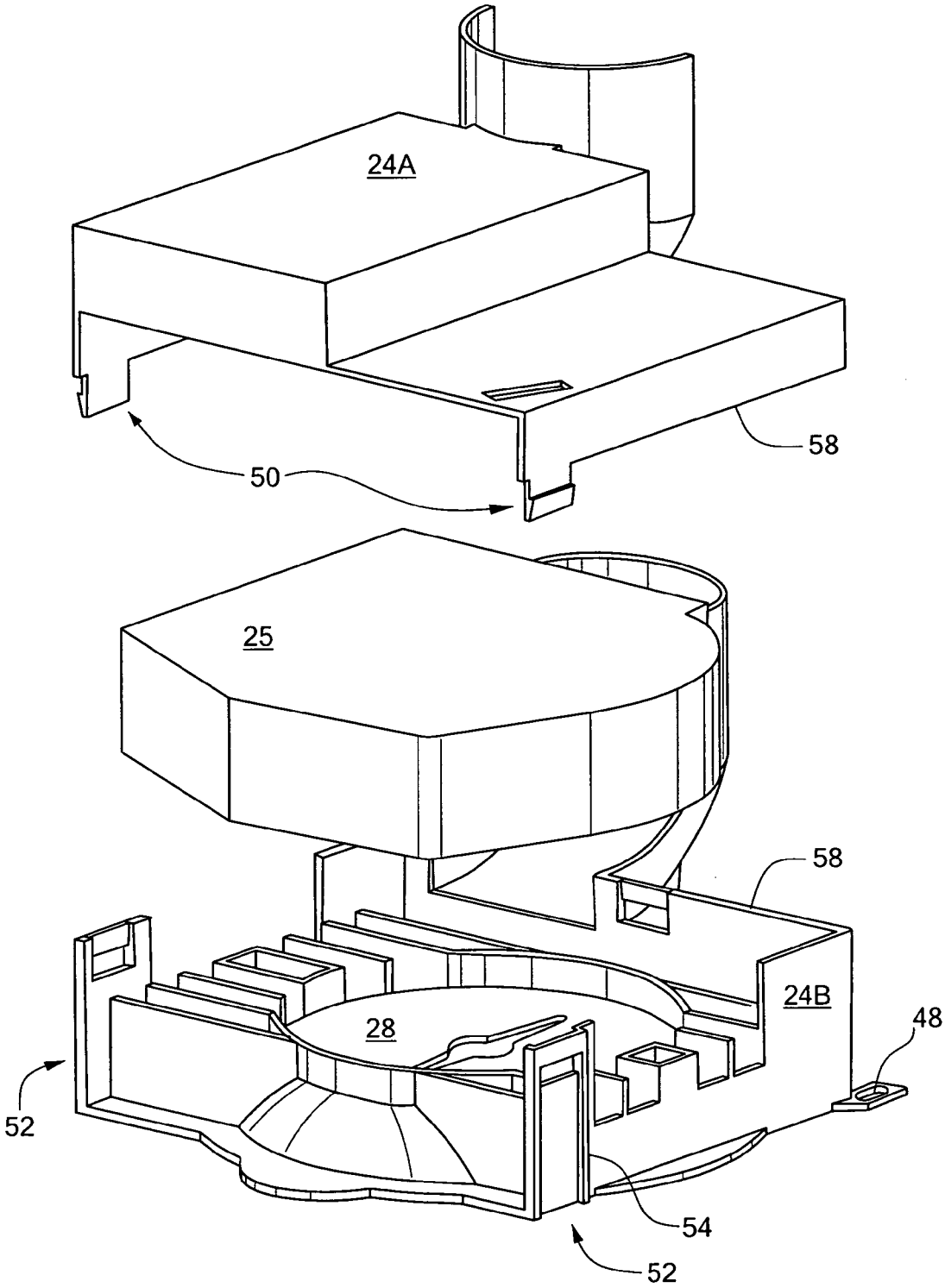
FIG. 5 schematically shows an exploded view of the draft inducer shown in FIG. 2.

FIG. 5 schematically shows an exploded view of the draft inducer 14 shown in FIG. 2. As shown, the housing 24 illustratively is formed from a top housing portion 24A that snap fits with a bottom housing portion 24B. To those ends, the top housing portion 24A has a pair of male clips 50 that mate with corresponding female clips 52 on the bottom housing portion 24B. Each female clip has a spring body 54 that enables it to flex away from the housing 24. Consequently, each female clip 52 can easily uncouple from its corresponding male clip 50. The top and bottom housing portions 24A and 24B also have a pivot connection 56 that enables the top housing portion 24A to pivot upwardly (relative to the bottom housing portion 24B) when the male and female clips 50 and 52 are unlatched.

When coupled, the edges of the top and bottom housing portions 24A and 24B seal the interior of the housing 24. To that end, the edges of the top and bottom housing portions 24A and 24B may be formed with a lap joint 58 to align and seal the housing portions 24A and 24B. Consequently, other than the noted inlets and outlets, the mixing chamber 28 should have no other vents to the exterior.

When the two housing portions 24A and 24B are uncoupled, the blower 25 may be easily removed, replaced, or both removed and replaced. For example, the blower 25 may be malfunctioning. In such case, the adapter 22 may be unplugged, the housing portions 24A and 24B may be uncoupled, and the blower 25 can be removed. After a new blower 25 is positioned in its interior (e.g., via another snap-fit), the housing 24 may be closed. The adapter 22 then may be reconnected to the AC outlet, thus permitting the draft inducer 14 to begin operating. In illustrative embodiments, the blower 25 is similar to the SPINNAKER™ blower, distributed by Comair Rotron of San Diego, Calif. In alternative embodiments, other air moving devices may be used, such as fans.

Figure 6:
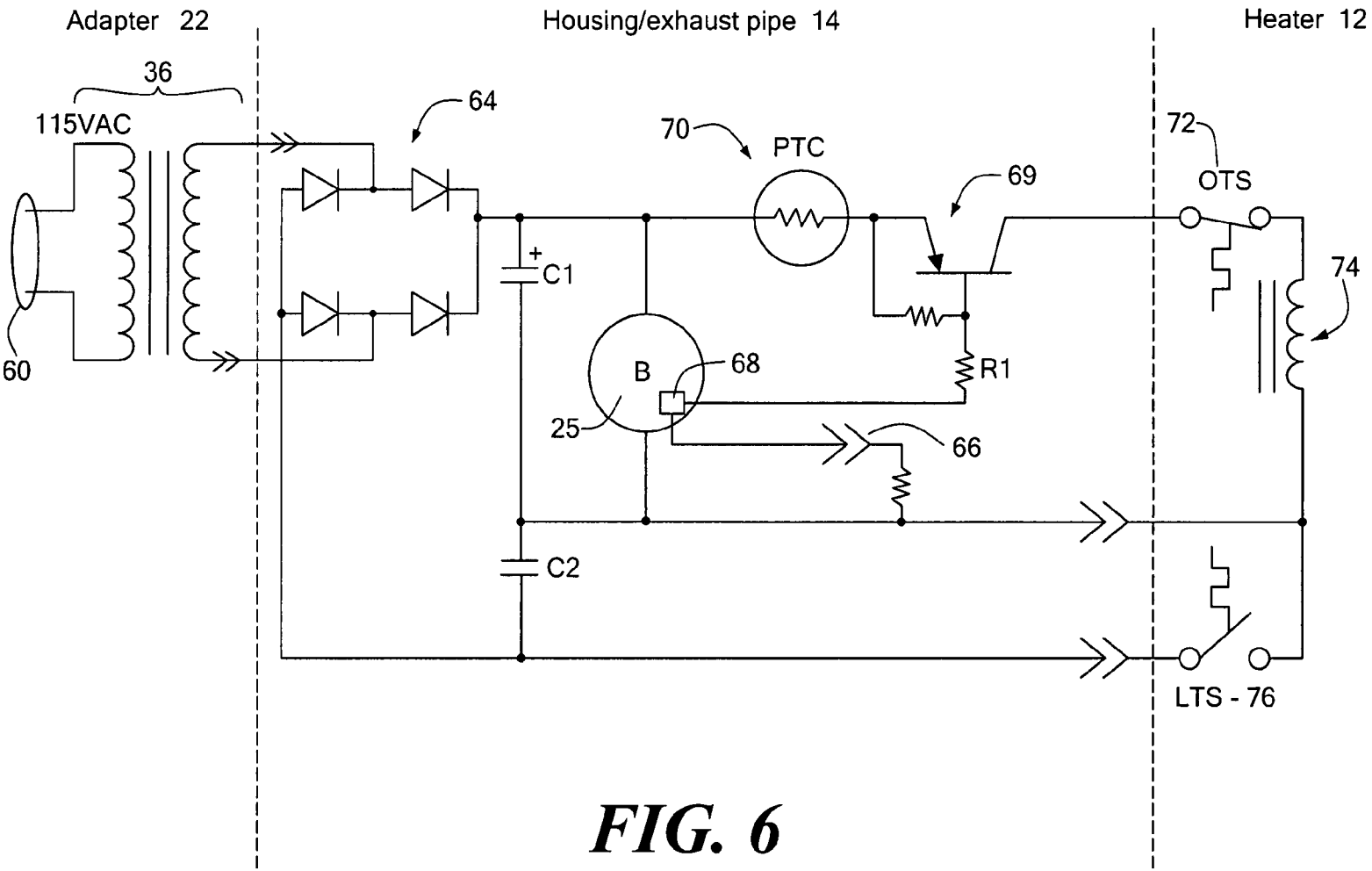
FIG. 6 schematically shows the electronic configuration and connections between the AC adapter, the draft inducer, and a corresponding hot water heater.

FIG. 6 schematically shows the general electronic configuration and connections between the adapter 22, the draft inducer 14, and the hot water heater 12. The various parts of the system 10 are divided by vertical dashed lines. In particular, relevant components of the adapter 22 are shown and identified by reference number 22, relevant components of the draft inducer 14 (i.e., noted as being within the housing 24 and/or exhaust pipe 20) are shown and identified by reference number 14, and relevant components of the heater 12 are shown and identified by reference number 12.

The adapter 22 includes an interface 60 (e.g., the prongs 34) for receiving the wall voltage (e.g., 115 volts AC), and the prior noted step-down transformer 36 for producing a stepped-down AC voltage (e.g., 24 volts AC). The stepped-down voltage then is fed to a bridge rectifier 64 (within the draft inducer housing 24), which converts the stepped-down AC voltage to a DC voltage (e.g., 24 volts DC). In alternative embodiments, rather than being within the draft inducer 14, the bridge rectifier 64 may be located within the adapter 22.

The draft inducer 14 also includes a first capacitor C1 (in parallel with the blower 25) that reduces ripple from the bridge rectifier 64 and stores the DC voltage received from the bridge rectifier 64. A second capacitor C2 in series with the first capacitor C1 provides noise suppression. More specifically, the second capacitor C2 protects a downstream switch 76 (discussed below) from arcing as it opens and closes. The second capacitor C2 does not provide any appreciable filtering. Accordingly, the capacitance of the first capacitor C1 may be selected to be much greater than that of the second capacitor C2. For example, the capacitance of the first capacitor C1 can be on the order of about 10,000 microfarads, while the capacitance of the second capacitor C2 can be on the order of about 0.1 microfarads. In alternative embodiments, the second capacitor C2 is omitted.

The blower 25 may include one or more program leads (shown schematically at reference number 66) that permit it to perform in pre-specified ways. For example, the blower 25 may be programmed to rotate at a speed (i.e., in RPMs) that is based upon the temperature of the exhaust fumes. To that end, the blower 25 may include hardware and/or software that perform the noted functions. For example, the blower 25 may include a processor 68 that executes a specified function based upon computer instructions. Different hardware within the blower 25 also may be configured to perform the noted functions.

The blower 25 includes internal circuitry (e.g., the processor 68) that produces a signal having a zero output state (e.g., logic level of zero) when the blower 25 is running (i.e., rotating at or above a pre-selected RPM value), and an open output state (e.g., logic level one) when the blower 25 is not running. This signal is transmitted directly to a switch 69 (via a resistor R1) that, consequently, is open when the blower 25 is off, and closed when the blower 25 is on. In illustrative embodiments, the switch 69 is a PNP bipolar junction transistor ("BJT") that is biased on when its base receives the noted zero output state.

The draft inducer 14 also includes a thermistor sensor 70 (shown in FIG. 3 as a "PTC 70"), which has a variable resistance that is proportional to the current through it (i.e., it acts as a reusable fuse), and an over temperature switch ("OTS 72") to ensure that the temperature of the exhaust/air mixture in the exhaust port 26 does not exceed a prescribed temperature. To that end, if the OTS 72 detects that the mixture exceeds such temperature, it opens, thus breaking the circuit to the heater 12. As a consequence, the heater 12 cannot continue to operate.

The heater 12 has a solenoid 74 that turns on the gas supply when on, and turns off the gas supply when off. Accordingly, when either the OTS 72 or switch 69 breaks the circuit, the solenoid 74 cannot function, consequently cutting off the supply of gas to the heater 12. Consequently, the heater 12 cannot burn gas, which produces exhaust fumes.

The heater 12 also includes a low temperature switch ("LTS 76"), which selectively turns the heater 12 on and off based upon water temperature within the tank. Specifically, the LTS 76 turns the heater 12 on (i.e., it closes) when it detects that the water temperature is below a pre-selected low temperature. In a corresponding manner, the LTS 76 turns the heater 12 off (i.e., it opens) when it detects that the water temperature is at or above a pre-selected high temperature.

Figure 7:
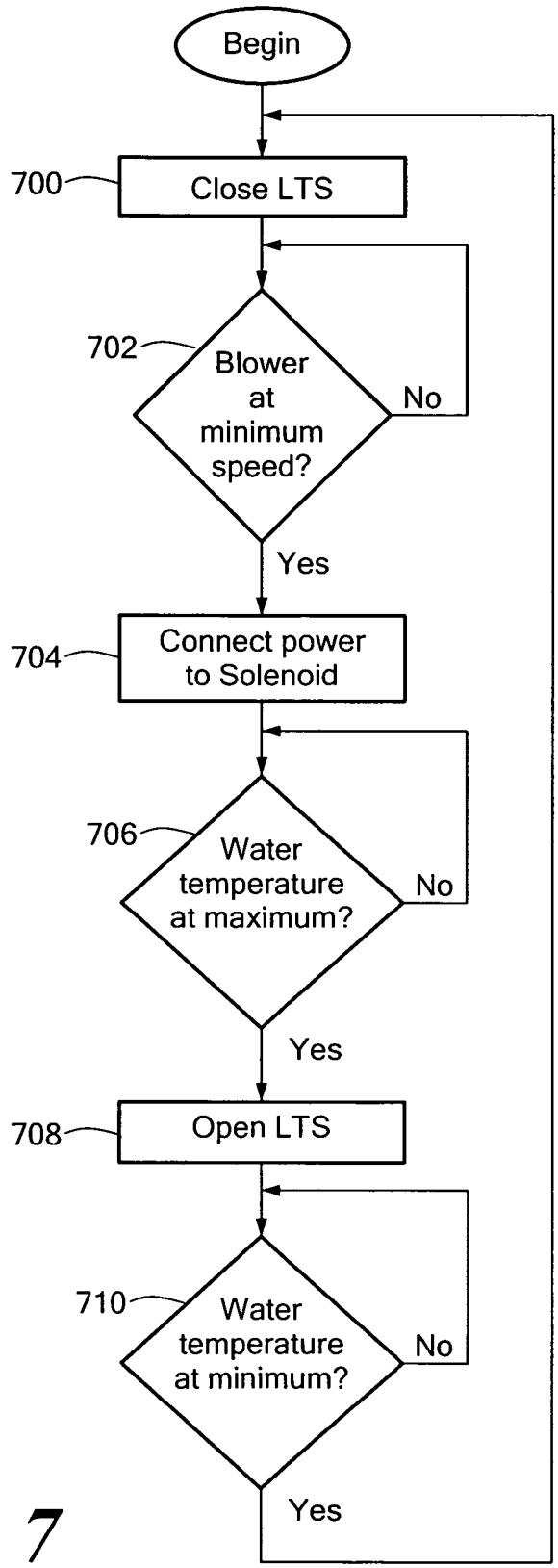
FIG. 7 shows an exemplary process executed by the electronic circuit shown in FIG. 6.

FIG. 7 shows an exemplary process executed by the electronic circuit shown in FIG. 6. The process begins at step 700, in which the low temperature switch 42 is closed to begin heating water in the tank. This connection provides the ground return for the blower 25, which causes it to begin rotating.

It then is determined at step 702 if the blower 25 is running at a predetermined minimum speed that can provide a sufficient pressure to perform the draft inducing function. This predetermined speed may be based upon a number of variables, such as the size of the hot water heater 12, the size of the blower 25 and inducer 14, and other known parameters associated with the system 10. In illustrative embodiments, the processor 68 makes this determination. The hot water heater 12 thus receives no power until the blower 25 reaches this minimum speed.

After the blower 25 reaches the minimum speed, the process continues to step 704, in which the solenoid 74 is connected to the power source. To that end, the processor 68 forwards a signal to the switch 69 (e.g., a logical zero). Upon receipt, the switch 69 closes, which connects the power source (i.e., the transformer 36 and rectifier 64) with the solenoid 74. Consequently, the solenoid 74 turns on the gas supply, which enables the hot water heater 12 to begin heating the water in its internal tank.

The hot water heater 12 continues to heat the water until it reaches a predetermined maximum temperature (step 706). When that temperature is reached, the hot water heater 12 opens its low temperature switch 46 (step 708), which effectively breaks the return path for the rectifier 64. As suggested above, due to its small capacitance, the second capacitor C2 does not provide a ground return path for the rectifier 64.

The water in the hot water heater 12 then cools until it reaches a predetermined minimum temperature (step 710). After it reaches the minimum temperature, the process repeats by looping back to step 700, in which the low temperature switch 700 is closed.

It should be noted that this process can be interrupted at any time for several reasons. Primarily, if the blower 25 malfunctions by not rotating rapidly enough, the switch 69 opens, which stops the hot water heater 12 from burning its fuel. In other words, if the blower 25 does not reach its predetermined speed, then the entire system 10 effectively shuts down. In such case, the blower 25 may be replaced in the manner discussed above. If the various parameters are properly selected, then this feature should help prevent the hot water heater 12 from generating more exhaust fumes than the inducer 14 can force from the system 10. The process also can be interrupted if the PTC 70 trips, which happens when the hot water heater 12 draws too much current, or if the air/exhaust mixture is too hot, which causes the over temperature switch 42 to open.

In addition to those discussed above, the draft inducer 14 provides a number of other advantages over many conventional draft inducers. Specifically, the draft inducer 14 requires a smaller blower 25 than many prior art draft inducers. As noted above, in illustrative embodiments, the blower 25 runs at 24 volts DC, while many available prior art blowers run at 115 volts AC. Consequently, the draft inducer 14 should have a lower power draw and a smaller profile. This smaller draft inducer 14 thus should generate less noise. Some of these advantages are enhanced with the embodiment that incorporates an external step-down transformer 36.

The draft inducer 14 is more versatile than prior art draft inducers having AC blowers. Specifically, because a DC blower is used, the draft inducer 14 may be programmed. Moreover, the embodiment with a remote step-down transformer 36 permits easy installation that typically should not require an electrician.

Moreover, in some embodiments, the draft inducer 14 can have a battery backup. In such case, the battery can bypass transformer 36 and rectifier 64. Accordingly, if there is a power failure, the battery can power the system 10.

Although various exemplary embodiments of the invention are disclosed above, it should be apparent that those skilled in the art can make various changes and modifications that will achieve some of the advantages of the invention without departing from the true scope of the invention.

What is claimed is:

1. A draft inducer system comprising:

a voltage reducer capable of converting an input AC voltage to a reduced voltage, the voltage reducer comprising:

a reducer housing;

a set of prongs extending from the reducer housing, the set of prongs capable of plugging into an AC outlet; and an output interface capable of delivering the reduced DC voltage, the system also including an inducer unit capable of being coupled with the output interface, the inducer unit comprising:

a unit housing;

an air moving device within the unit housing; and a mixing chamber formed by the unit housing, the mixing chamber having an exhaust input to receive exhaust from a burning fuel, the mixing chamber also having an ambient air input for receiving ambient air, the ambient air mixing with the exhaust in the mixing chamber to produce mixed air, the mixing chamber also having a mix output capable of directing the mixed air from the mixing chamber wherein the voltage reducer includes a cord that terminates at the output interface, the output interface being removably coupleable with the inducer unit.

2. A draft inducer system comprising:

a voltage reducer capable of converting an input AC voltage to a reduced voltage, the voltage reducer comprising:

a reducer housing;

a set of prongs extending from the reducer housing, the set of prongs capable of plugging into an AC outlet; and an output interface capable of delivering the reduced DC voltage, the system also including an inducer unit capable of being coupled with the output interface, the inducer unit comprising:

a unit housing;

an air moving device within the unit housing; and a mixing chamber formed by the unit housing, the mixing chamber having an exhaust input to receive exhaust from a burning fuel, the mixing chamber also having an ambient air input for receiving ambient air, the ambient air mixing with the exhaust in the mixing chamber to produce mixed air, the mixing chamber also having a mix output capable of directing the mixed air from the mixing chamber wherein the inducer unit includes rectification circuitry to produce a substantially DC input voltage from the reduced voltage.

3. A draft inducer for controlling the exhaust of a fuel burning system, the fuel burning system igniting to burn fuel after control circuitry that is a part of the system is energized, the draft inducer system including:

an input for receiving power;

an air moving device energized by power received from the input;

an output for selectively delivering the power to the control circuitry, the control circuitry being energized by the power received via the output, the output switching the power to the control circuitry on and off as a function of the rotational speed of the air moving device; and a switch coupled between the input and the output, the switch being configured to provide a closed circuit at least a part of the time when the temperature of the mixture does not exceed a predetermined value;

wherein the fuel burning system produces an exhaust gas, the draft inducer mixing air with the exhaust gas to produce a mixture.

4. The draft inducer as defined by claim 3 wherein the switch is configured to provide an open circuit when the temperature of the mixture exceeds the predetermined value, the open circuit preventing power from being delivered from the output.

5. The draft inducer as defined by claim 3 wherein the air moving device includes a DC blower.

6. The draft inducer as defined by claim 3 further including a housing containing the air moving device.

7. A draft inducer for controlling the exhaust of a fuel burning system, the fuel burning system igniting to burn fuel after control circuitry that is a part of the system is energized, the draft inducer system including:

an input for receiving power;

an air moving device energized by power received from the input;

an output for selectively delivering the power to the control circuitry, the control circuitry being energized by the power received via the output, the output switching the power to the control circuitry on and off as a function of the rotational speed of the air moving device further including a voltage reducer capable of reducing an input AC voltage to a reduced voltage, the voltage reducer having a reducer housing and a set of prongs extending from the housing, the set of prongs being capable of plugging into an AC outlet, the voltage reducer also having an output interface capable of delivering the reduced voltage to the input; and a housing containing the air moving device.

8. The draft inducer as defined by claim 7 further including a processor that detects the rotational speed of the air moving device, the processor producing a power signal when the air moving device rotates at a predetermined rotational speed, generation of the power signal causing the output to deliver power to the control circuitry.

9. The system as defined by claim 7 further including a hot water heater, the unit housing being mounted to the hot water heater, the hot water heater burning the fuel to produce the exhaust.

10. The draft inducer as defined by claim 7 further including a switch between the input and the output, the switch being configured to provide a closed circuit when the air moving device is operating at least at a predefined speed.

11. The draft inducer as defined by claim 7 wherein the switch is configured to provide an open circuit when the air moving device is operating below the predefined speed, the open circuit preventing power from being delivered from the output.

* * * * *